United States Patent [19]

White

[11] 4,088,567

[45] May 9, 1978

[54] SOLIDS REMOVAL AND FLUID CATALYTIC CRACKING OF A SYNTHETIC HYDROCARBON STREAM DERIVED FROM HYDROCARBON-CONTAINING SOLIDS

[75] Inventor: Robert J. White, Richmond, Calif.

[73] Assignee: Chevron Research Company, San Francisco, Calif.

[21] Appl. No.: 747,269

[22] Filed: Dec. 3, 1976

[51] Int. Cl.[2] ..... C10G 11/00

[52] U.S. Cl. ..... 208/113; 208/251 R

[58] Field of Search ..... 208/113, 164, 251 R, 208/253, 8, 10, 11 R

[56] References Cited

U.S. PATENT DOCUMENTS

| | | | |
|---|---|---|---|
| 2,742,405 | 4/1956 | Mattox | 208/113 |
| 2,891,005 | 6/1959 | Heinrich | 208/253 |
| 3,226,316 | 12/1965 | Metrailer et al. | 208/251 R |
| 3,275,546 | 9/1966 | Retallick | 208/10 |
| 3,546,103 | 12/1970 | Hamner et al. | 208/253 |
| 3,617,481 | 11/1971 | Voorhies et al. | 208/253 |
| 3,652,446 | 3/1972 | Dengler et al. | 208/10 |
| 3,983,030 | 9/1976 | Rosynek et al. | 208/253 |

*Primary Examiner*—Delbert E. Gantz
*Assistant Examiner*—James W. Hellwege
*Attorney, Agent, or Firm*—D. A. Newell; R. H. Davies; J. J. DeYoung

[57] ABSTRACT

Disclosed is a process for the removal of solids and the fluid catalytic cracking of a synthetic hydrocarbon stream having a 90% boiling point above 800° F and containing finely divided solids. The stream is cracked under low-severity cracking conditions, and a first portion of the solids is removed along with the spent catalyst and separated from the spent catalyst in a catalyst regeneration zone. A second portion of the solids is removed by conventional means from the catalytically cracked product to form a product synthetic crude essentially free of solids.

9 Claims, 1 Drawing Figure

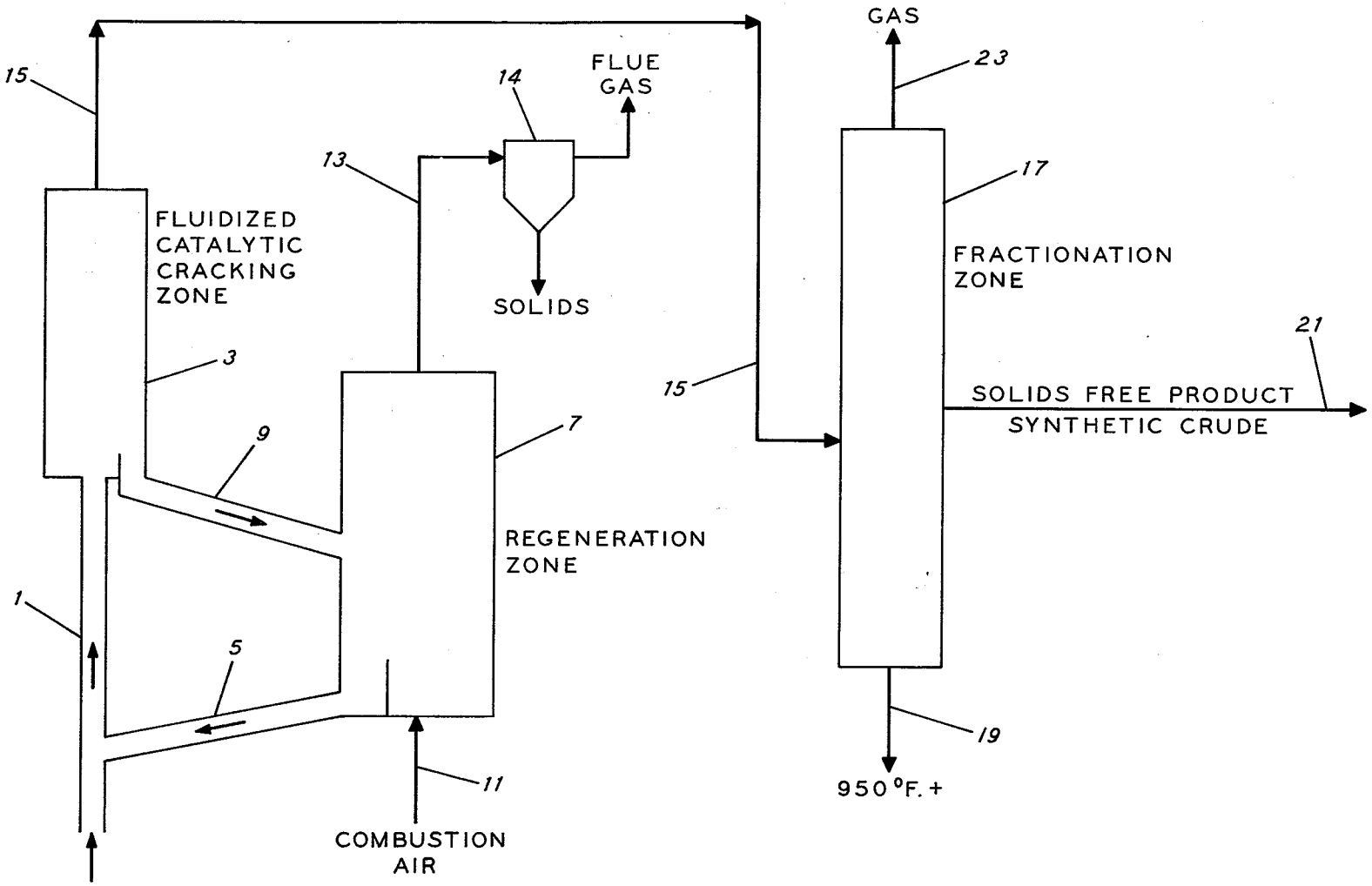
GAS
23
17
FRACTIONATION ZONE
SOLIDS FREE PRODUCT
SYNTHETIC CRUDE
21
19
950°F.+
15
FLUE GAS
14
SOLIDS
13
7
REGENERATION ZONE
11
COMBUSTION AIR
FLUIDIZED CATALYTIC CRACKING ZONE
3
9
5
15
1

SOLIDS REMOVAL AND FLUID CATALYTIC CRACKING OF A SYNTHETIC HYDROCARBON STREAM DERIVED FROM HYDROCARBON-CONTAINING SOLIDS

BACKGROUND OF THE INVENTION

The present invention relates to fluid catalytic cracking and the removal of solids from a synthetic liquid hydrocarbon stream derived from hydrocarbon-containing solids.

Numerous processes are well known in the art for the production of synthetic crudes from hydrocarbon-containing solids, for example, coal liquefaction, coal carbonization and shale retorting processes.

One problem encountered in these processes is that of the presence of finely divided solids in the liquid product. Typically the solids range in size from about 0.5 to 50 microns. Coal, for example, can be converted to a valuable product by subjecting coal to solvent extraction to produce a mixture of coal extract and undissolved coal residue. The organic matter is taken into solution by either hydrogen-donor solvent, for example tetralin, or a coal-derived (process-derived) solvent in the presence of hydrogen or a synthesis gas.

Attempts to provide an effective process for converting hydrocarbon-containing solids, particularly coal, to petroleum-like products have generally not been successful as a result of the difficulties encountered in efficiently and effectively separating the insoluble solids from the crude product. In prior art processes, the insoluble residue is typically separated from the liquid product by filtration, centrifuges, hydrocyclones, settling or vapor stripping.

Another problem encountered with raw synthetic crudes is that high-molecular-weight hydrocarbons boiling above 800° F and typically above 1000° F are formed. These high-molecular-weight products tend to further increase the difficulty in separating the finely divided solids from the synthetic crude.

Yet another problem encountered with synthetic crudes is that the crude appears to be unstable and has a tendency to form additional high-molecular-weight polymeric materials further complicating the removal of solids if the synthetic crude is not immediately processed.

It is well known in the art that heavy petroleum fractions can be converted into lighter, more valuable fractions by cracking processes. Thermal cracking accomplishes conversion of high-molecular-weight compounds to lower-molecular-weight compounds by using heat only, while catalytic cracking provides a more selective conversion at lower temperatures. Fixed-bed, fluid-bed and moving-bed catalytic cracking processes are all well known in the art.

In fluid catalytic cracking, the cracking catalyst is maintained in a fluidized state and the feed enters the bottom of the reaction zone and cracks as it passes through the reactor. Carbonaceous material formed during cracking, usually referred to as "coke", is deposited on the catalyst surfaces, thus reducing its activity. It is therefore necessary to regenerate the catalyst so that it can be used again, and this is accomplished by burning off the carbon deposits. Spent catalyst is continuously drawn off from the reactor and passed to a catalyst regeneration zone where the coke deposits are burned off.

Typically, fluid catalytic cracking conditions include a temperature in the range of 850° to 1050° F, a weight hourly space velocity of 1 to 2, a catalyst to oil ratio of 8 to 10, and a severity factor of 5 to 8, where the severity factor is equal to the catalyst oil ratio divided by the weight hourly space velocity. Typically the object of fluid catalytic cracking is to produce as much gasoline stock as possible, that is, material boiling below 430°. Generally process conditions are maintained to provide a per-pass conversion of 50 to 80% of the feed to 430° F-material. Typically, petroleum feedstocks fed to a fluid catalytic cracker are first subjected to a distillation to remove solid contaminants which tend to deactivate the catalyst. Generally feedstocks fed to the fluid catalytic cracker must have high hydrogen/carbon atomic ratios greater than about 1.5 in order that coke deposits do not accumulate too rapidly.

The catalytic cracking of liquids derived from hydrocarbon-containing solids is known in the art, as shown, for example, in U.S. Pat. Nos. 3,700,586 and 3,652,446. However, in these prior art processes either solids have already been removed from the feed material or the feed material has undergone a prior hydroprocessing step to increase the hydrogen content of the feed material to prevent excessive coking in the catalytic cracker or to produce conventional catalytic cracker products, particularly gasoline boiling below 430° F.

SUMMARY OF THE INVENTION

A process for upgrading a synthetic liquid hydrocarbon stream having a 90% boiling point above 800° F and containing finely divided solids which are insoluble in said hydrocarbon stream, which comprises:

(a) introducing said stream into a catalytic cracking zone containing a fluidized cracking catalyst and catalytically cracking said stream under low-severity cracking conditions, including a per-pass conversion of less than 25 weight percent of said stream to products boiling below 430° F whereby carbon deposits on said catalyst, forming spent catalyst;

(b) removing from said cracking zone a first effluent comprising said spent catalyst and a first portion of said solids;

(c) combusting the carbon on said catalyst in the presence of said first portion of said solids whereby a flue gas is produced containing at least a substantial portion of said first portion of said solids;

(d) removing from said cracking zone a second effluent stream comprising catalytically cracked hydrocarbons and a second portion of said solids.

BRIEF DESCRIPTION OF THE DRAWING

The FIGURE is a simplified flow diagram of one preferred embodiment of the invention.

DETAILED DESCRIPTION OF THE INVENTION AND PREFERRED EMBODIMENT

One object of the present invention is to provide a process for upgrading a raw synthetic hydrocarbon stream obtained from hydrocarbon-containing solids prior to any other processing steps, particularly prior to any other solids separation or hydroprocessing steps.

Another object of the present invention is to provide a process for the removal of solids from a synthetic liquid hydrocarbon stream.

A further object of the present invention is to produce a product synthetic crude of reduced molecular weight from a raw synthetic liquid hydrocarbon stream derived from hydrocarbon-containing solids and which contains finely divided solids.

The term "synthetic liquid hydrocarbons" as used in the present invention refers to the $C_5+$ boiling range liquids obtained from any hydrocarbon-containing solids such as coal, oil shale, tar sands, garbage, lignite, peat, etc.

Feedstock Production

The present invention is directed to the treatment of a fresh or raw feedstock comprising synthetic liquid hydrocarbons and finely divided solids obtained by conventional processes from a hydrocarbon-containing solid.

Numerous processes are well known in the art for the production of synthetic liquid hydrocarbons, for example coal liquefaction, coal pyrolysis and shale oil retorting processes. Numerous processes for producing the feedstock of the present invention are disclosed in "Synthetic Fuels Data Handbook", Cameron Engineers, Inc. (1975), the entire disclosure of which is incorporated herein by reference.

In a typical coal liquefaction process, the organic material in the coal is taken into solution by either a hydrogen donor solvent or a coal-derived solvent in the presence of hydrogen or synthesis gas. The macromolecules of the coal are initially thermally disintegrated, under the temperatures and pressures of reaction, yielding reactive fragments or free radicals which are stabilized by the addition of hydrogen. This hydrogen is derived from either a hydrogen donor solvent (which itself becomes more aromatic in the process), or directly from gaseous hydrogen. A representative coal liquefaction process is the Solvent Refined Coal process described at page 223 in the aforementioned Synthetic Fuels Data Handbook. The resulting liquids typically contain solids in the form of coal ash.

The typical carbonization process involves the decomposition of coal in the absence of air, which results in the evolution of gases and liquids. The resulting product liquids typically contain solids in the form of coal char.

The typical shale retorting process, for example, the Petrosix or Paraho processes described in the aforementioned Synthetic Fuels Data Handbook, produce a liquid product containing shale fines.

More prior art processes for the production of liquid hydrocarbons from solids also include conventional means for separations of the solids from the synthetic liquid hydrocarbons. It is assumed in the present application that the raw synthetic crude feedstock still contains finely divided solids.

The finely divided solids are insoluble in the synthetic liquid feed stream and will vary in size and composition, depending on the source of the synthetic liquid. For example, if the synthetic liquid hydrocarbon stream is derived from coal, the fines will comprise undissolved coal and coal ash and comprise 1 to 10 weight percent of the feedstock, and will typically be in the size range of 0.5 to 20 microns. If the synthetic liquid hydrocarbon stream is obtained from a shale retorting process, then the fines may generally be somewhat larger in size, for example 1 to 50 microns, and the feedstock may contain a smaller portion of solids, for example in the range 0.1 to 5 weight percent.

Generally, the feedstock can be described as containing solids in the 1 to 50 micron range with 0.1 to 10 weight percent solids.

The molecular weight of the feedstock will also vary, depending on the source, but the feedstock will generally comprise a relatively high-molecular-weight feed having a 50% boiling point range in the 550° to 800° F range and a 90% boiling point above 800° F and more typically in the range 900°–1000° F.

Fluid Catalytic Cracking

Conventional fluid catalytic cracking equipment may be utilized in the present invention. However, it is critical to the present invention that the fluid catalytic cracking take place under low-severity cracking conditions. It is essential to the present invention to maintain low-severity conditions in order to prevent the excessive formation of coke in the fluid catalytic cracker and prevent the rapid deactivation of the catalyst. The conditions employed must be mild enough to maintain a per-pass conversion of less than 25 weight percent of the feed stream to products boiling below 430° F, and preferably less than 20 weight percent conversion to products boiling below 430° F. Preferably the catalytic cracker is operated on a once-through feedstock basis with no recycle of any of the cracked product. To obtain the above conversion, numerous fluid catalytic cracking parameters can be varied, but typically the conditions required will include a temperature in the range of 850° to 1050° F, preferably 900° to 950°, a weight hourly space velocity in the range 3 to 30, preferably 5 to 10, a catalyst-to-oil ratio 0.1 to 4.0 pounds per pound and preferably 0.5 to 2 pounds per pound, a severity factor 0.005 to 1.5, preferably 0.2 to 1.0, where the severity factor is the catalyst-to-oil ratio divided by the weight hourly space velocity. As is well known in the catalytic cracking art, molecular hydrogen is not added to the fluid catalytic cracking zone and the feedstock to the catalytic cracker in the present invention is essentially free of hydrogen or other normally gaseous components.

These cracking conditions can be compared to typical prior art conditions for the fluid catalytic cracking of a petroleum distillate stock boiling in the range 600° to 1000° F. Typical prior art conditions include a temperature in the range 875° to 1000° F, a weight hourly space velocity in the range 1 to 2, a catalyst-to-oil ratio of 8 to 10 pounds per pound, and a severity factor of 8 to 5. Comparing severity factors, the severity conditions of the present invention are at least 3 and preferably at least 10 times lower than in the typical catalytic cracking process.

Conventional fluid catalytic cracking catalysts are used in the process of the present invention. For example, a suitable catalyst such as silica-aluminia, silica-magnesia, and cracking clay can be used. However, the preferred catalysts of the present process are the crystalline aluminosilcate zeolite-types. These zeolites include synthetic crystalline alumino-silicates, naturally occurring crystalline aluminosilicates and treated clays in which a substantial portion of the clay has been converted to crystalline zeolite. Synthetic materials include faujasites and mordenites. All or a portion of the cations of the zeolites, such as sodium cations, can be replaced with hydrogen ions, ammonium ions or metal ions such as rare earths, manganese, cobalt, zinc, and other metals of Group I through Group VIII of the Periodic Table. The catalyst can be one of the matrix types, that is, one in which the zeolite crystals are coated with or encapsulated in a siliceous or silica-alumina gel.

Spent Catalyst Regeneration and Solids Separation

During the cracking operation, coke deposits on the catalyst, forming spent catalyst. The first portion of the finely divided solids is removed from the reaction zone either as fine deposited on the catalyst along with the coke or carbon and/or carbon-fines agglomerates. During the cracking process as the coke builds upon on the catalyst, portions of the finely divided solids may also deposit on the catalyst along with the coke. Also, carbon-fines agglomerates may also form during the cracking process and, if these agglomerates are similar in size to that of the spent catalyst, then they will pass out of the reaction zone to the regeneration zone along with the spent catalyst. The spent catalyst is removed from the cracking zone by conventional means along with the first portion of the finely divided solids. The carbon is burned from the catalyst in a conventional regeneration zone. As the carbon burns in the regeneration zone, the fines are liberated from the catalyst and any carbon-fines agglomerates disintegrate. Substantially all (90 weight percent or more) of the fines are entrained out of the regeneration zone along with the combustion gas, while the regenrated catalyst is returned to the catalytic cracking zone. A small portion of the fines may be carried back into the catalytic cracker along with the catalyst. The catalytic cracking catalyst is sufficiently larger in size such that it is not entrained out of the regeneration zone along with the finely divided solids.

Only a portion of the fines contained in the feed steam will be removed via the regeneration zone. The remaining solids will pass out of the catalytic cracking zone along with the cracked hydrocarbons. The portion of solids removed via the regeneration zone as compared to the portion removed along with the reactor effluent will vary greatly, depending upon the many interrelated operating variables common to catalytic cracking operations, but generally it is preferred that at least 25 weight percent of the solids are removed via the catalyst regeneration zone and preferably at least 50 weight percent. The second portion of solids which is removed with the catalytically cracked product is separated from the cracked hydrocarbons by conventional means, for example hydrocyclones, filtration, centrifugation, gravity settling, etc., thereby forming a product synthetic crude which is essentially free of solids, i.e., less than 0.5 weight percent and perferably less than 0.01 weight percent. Preferably the remaining solids are removed as a bottoms stream from a fractionation zone.

In contrast to the objective of most fluid catalytic cracking processes which is to produce much lower boiling products, particularly those boiling below 430° F, the normally liquid product of the present invention still contains many high boiling hydrocarbons due to the extremely low severity cracking conditions. Generally, the low-severity cracking conditions of the present invention will lower the 50 to 90 percent boiling points of the normally liquid product by 10° to 100° F.

PREFERRED EMBODIMENT OF THE INVENTION

Now refer to FIG. 1, which illustrates one preferred embodiment of the invention. A synthetic liquid hydrocarbon stream is introduced by conventional means into a conventional fluid catalytic cracking zone 3 via line 1. Regenerated catalyst may be introduced into line 1 via line 5 from the catalyst regeneration zone 7. The catalyst is maintained in a fluidized state by the upflowing varporous hydrocarbons. Preferably the feed material comprises a coal liquefaction product having a 50% ASTM boiling point of 550 to 800° F and a 90% boiling point above 800° F. The content of finely divided solids in the feed will be in the range 1 to 10 weight percent. In the fluid catalytic cracking zone the carbon deposits on the catalyst and the first portion of the finely divided solids deposit on the catalyst and/or forms carbon-fine agglomerates. The spent catalyst and the first portion of the solids are removed via line 9 and passed by gravity flow, for example, to conventional regeneration zone 7 wherein combustion air is injected via line 11. Preferably the catalyst is substantially larger in size than the catalyst fines, and as the carbon is combusted and the finely divided solids are entrained out of the regeneration zone with the flue gas via line 13. This first portion of the finely divided solids are then separated from the flue gas by conventional means, for example by the use of a cyclone separator 14.

The reactor effluent, including the cracked hydrocarbons and a second portion of entrained finely divided solids, is removed from the fluid catalytic cracker via line 15. This stream is then fed to a second solids separation zone, preferably fractionation zone 17. A heavy bottoms stream is removed via line 19. The bottoms stream contains essentially all of the solids removed with the reactor effluent. The cut point of the bottoms stream is controlled to maximize the solids content in the bottoms stream. Generally, in order to be able to easily remove the bottoms stream from the fractionator, it must not contain more than about 50 weight percent solids and preferably less than 30 weight percent solids. The bottoms cut will generally boil at a temperature higher than 900° F, but in any event the cut is controlled in order to minimize the loss of hydrocarbons. At least one lower-boiling normally liquid fraction is removed from the fractionator via line 21. This fraction is essentially free of solids, that is, less than 0.01 weight percent. The synthetic liquid crude product or particular fractions thereof may then be fed to any of the other well known refinery processes such as alkylation, isomerization, refomring, hydrofining, etc. Gaseous products produced in the cracking zone are removed from the fractionation zone via line 23 and will normally comprise $C_4$ and lighter boiling hydrocarbons.

What is claimed is:

1. A process for upgrading a synthetic liquid hydrocarbon stream derived from hydrocarbon-containing solids having a 90% boiling point above 800° F and containing from 0.1 to 10 weight percent of finely divided solids which are insoluble in said hydrocarbon stream, which comprises:

(a) contacting said stream with a fluidized cracking catalyst in a catalytic cracking zone and catalytically cracking said stream under low-severity cracking conditions including a per-pass conversion of less than 25 weight percent said stream to products boiling below 430° F, whereby carbon deposits on said catalyst, forming spent catalyst;

(b) removing from said cracking zone a first effluent comprising said spent catalyst and a first portion of said solids, said first portion of said solids comprising fines deposited with carbon on said spent catalyst or carbon-fines agglomerates, or a combination thereof;

(c) introducing said spent catalyst and said first portion of said solids into a catalyst regeneration zone and combusting at least a portion of said carbon thereby introduced, whereby a flue gas is produced, and removing at least a substantial portion of said first portion of said solids from said regeneration zone entrained in said flue gas;

(d) removing from said cracking zone a second effluent stream comprising catalytically cracked hydrocarbons and a second portion of said solids, and separating essentially all said second portion of said solids from at least a part of said catalytically cracked hydrocarbons.

2. The process of claim 1 wherein said second portion of said solids is essentially all separated from at least part of said catalytically cracked hydrocarbons by fractionation.

3. The process of claim 1 wherein said low-severity catalytic cracking conditions include a temperature in the range 900 to 950° F, a weight hourly space velocity in the range 3 to 30, and a catalyst-to-oil ratio from 0.1 to 4.0 pounds per pound.

4. The process of claim 1 wherein said synthetic liquid hydrocarbon stream is derived from oil shale.

5. The process of claim 1 wherein said synthetic liquid hydrocarbon stream is derived by coal liquefaction.

6. The process of claim 1 wherein said synthetic liquid hydrocarbon stream is derived by coal carbonization.

7. The process of claim 1 wherein said first portion of said solids includes at least 25 weight percent of said solids.

8. The process of claim 1 wherein said first portion of said insoluble material comprises at least 50 weight percent of said insoluble material.

9. A process for upgrading a synthetic liquid hydrocarbon stream derived from hydrocarbon-containing solids having a 90% boiling point above 800° F and containing from 0.1 to 10 weight percent of finely divided solids which are insoluble in said hydrocarbons, which comprises:

(a) contacting said stream with a fluidized cracking catalyst in a catalytic cracking zone and catalytically cracking said stream under low-severity cracking conditions including a per-pass conversion of less than 25 weight percent of said stream to products boiling below 430° F, whereby carbon deposits on said catalyst, forming a spent catalyst;

(b) removing from said cracking zone a first effluent stream comprising said spent catalyst and a first portion of said solids, said first portion of said solids comprising fines deposited with carbon on said spent catalyst or carbon-fines agglomerates, or a combination thereof;

(c) introducing said spent catalyst and said first portion of said fines into a catalyst regenerating zone and combusting at least a portion of said carbon thereby introduced, whereby a flue gas is produced, and removing at least a substantial portion of said first portion of said solids from said regeneration zone entrained in said flue gas;

(d) removing from said cracking zone a second effluent stream comprising said catalytically cracked hydrocarbons and a second portion of said solids;

(e) separating said second effluent stream into at least a higher-boiling fraction containing said second portion of said solids and a lower-boiling fraction essentially free of said solids.

* * * * *